US007632437B2

(12) United States Patent
Gullette

(10) Patent No.: US 7,632,437 B2
(45) Date of Patent: Dec. 15, 2009

(54) COLUMN FORM WITH CHAMFER FORMING ELEMENTS AND METHOD OF PRODUCING A COLUMN HAVING CHAMFERED EDGES

(76) Inventor: Jon Michael Gullette, 538 Magnolia Bend, League City, TX (US) 77573

( * ) Notice: Subject to any disclaimer, the term of this patent is extended or adjusted under 35 U.S.C. 154(b) by 240 days.

(21) Appl. No.: 11/582,819

(22) Filed: Oct. 18, 2006

(65) Prior Publication Data

US 2007/0101673 A1 May 10, 2007

Related U.S. Application Data

(60) Provisional application No. 60/729,553, filed on Oct. 25, 2005.

(51) Int. Cl.
*E04G 21/02* (2006.01)
*E04G 13/02* (2006.01)

(52) U.S. Cl. ..... 264/31; 52/745.17; 249/48

(58) Field of Classification Search ..... 249/48, 249/49, 50, 51, 177; 264/32, 31; 52/745.17
See application file for complete search history.

(56) References Cited

U.S. PATENT DOCUMENTS 975,135 A * 11/1910 Kelsey et al. ..... 249/51
986,957 A * 3/1911 Wallin ..... 249/51
1,183,169 A * 5/1916 Crist ..... 249/49
1,220,083 A * 3/1917 Fouse ..... 249/48
1,398,412 A * 11/1921 Barkschat ..... 249/48
1,627,754 A * 5/1927 Townsend ..... 249/51
2,093,346 A * 9/1937 Badt ..... 249/48
2,351,164 A * 6/1944 Troiel ..... 249/93
2,378,814 A * 6/1945 Wascher ..... 249/51
2,448,883 A * 9/1948 Hall ..... 249/51
2,975,498 A 3/1961 Plattner
3,107,087 A * 10/1963 Williams ..... 249/188
3,260,493 A * 7/1966 Beckham ..... 249/48
3,378,971 A 4/1968 Singer et al.
3,682,434 A 8/1972 Boenig
3,724,801 A * 4/1973 Sels et al. ..... 249/48
RE27,732 E 8/1973 Van Buren
3,795,393 A 3/1974 Melfi
3,828,513 A 8/1974 Vanderklaauw
3,857,540 A * 12/1974 Ecker ..... 249/48
4,083,526 A 4/1978 Hatfield
4,424,951 A * 1/1984 Spencer ..... 249/48
4,749,165 A * 6/1988 Moraca ..... 249/48
5,255,888 A * 10/1993 Workman ..... 249/48
5,616,271 A * 4/1997 Podgurski ..... 249/48
5,909,984 A * 6/1999 Matthews ..... 249/48
6,027,094 A 2/2000 Tian (Continued)

FOREIGN PATENT DOCUMENTS

GB 2 056 538 3/1981

(Continued)

*Primary Examiner*—Michael Safavi

(57) ABSTRACT

A device and method for creating a support structure. The device includes a pair of L-shaped form members connectable on their outer edges thereby producing a forming region therein. The form includes chamfer members disposable within the corners within the inner periphery of the form member. Also included, are sealing members for sealing the formable material placed in the form, wherein the sealing members include a chamfer member on one of their ends.

2 Claims, 4 Drawing Sheets

U.S. PATENT DOCUMENTS

| | | | | |
|---|---|---|---|---|
| 6,151,851 | A | 11/2000 | Carter | |
| 6,865,859 | B2 * | 3/2005 | Flathau | 249/48 |
| 2002/0152695 | A1 | 10/2002 | Gilsdorf | |
| 2004/0244667 | A1 | 12/2004 | Veazey | |
| 2005/0186034 | A1 | 8/2005 | Hall | |

FOREIGN PATENT DOCUMENTS

| | | | |
|---|---|---|---|
| JP | 402252832 | A | 10/1990 |
| JP | 403260264 | A | 11/1991 |
| JP | 405033491 | A | 2/1993 |

* cited by examiner

COLUMN FORM WITH CHAMFER FORMING ELEMENTS AND METHOD OF PRODUCING A COLUMN HAVING CHAMFERED EDGES

RELATED APPLICATIONS

This application claims priority from co-pending U.S. Provisional Application No. 60/729,553, filed Oct. 25, 2005, the full disclosure of which is hereby incorporated by reference herein.

FIELD OF THE DISCLOSURE

The present invention relates to the field of forms for structural supports. The present invention further relates to a form comprised of modular components for structural supports, where the form includes chamfer elements for modifying the shape of the final product.

BACKGROUND INFORMATION

Structural supports, may be formed from a curable material, such as cementitious materials, i.e., cement concrete, including resin and other polymeric compounds. Pouring the uncured material into a form, until the material cures and hardens typically produces these supports. These forms are generally made up of multiple sections that are assembled on the site. For examples, plywood sheets may be nailed together to create a form then the curable material is poured into the form where it solidifies. After the structure is satisfactorily cured, the form is then removed. Due to the fragile nature of the plywood, it is often destroyed during dismantling of the form. Also, when these forms are made from such expendable materials, the time taken in creating forms for a unique application is often large as well as costly. These forms can range in height from less than a foot to in excess of 20-30 feet. Often, especially when combined with cement or concrete, structural steel is run parallel to the form along the inside of the form. Typically the structural steel comprises structural reinforcing bar (rebar) for the purpose of adding strength and durability to the final structure. The final structure form can be used as a support for buildings, bridges, homes, and other large facilities having large innate structural needs.

Examples of such forms may be found in the following patents, U.S. Pat. No. 4,424,951, U.S. Pat. No. 3,682,434, JP 403260264A, JP 405033491A, U.S. Pat. No. 3,795,393, U.S. Pat. No. 3,724,801, U.S. Pat. No. 2,975,498, JP 402252832A, patent application Publication No. US 2005/0186034, U.S. Pat. No. 3,828,513, U.S. Pat. No. 6,027,094, GB 2 056 538, U.S. Pat. No. 3,378,971, U.S. Pat. No. RE27,732, patent application Publication No. US 2004/0244667, U.S. Pat. No. 4,083,526, patent application Publication No. US 2002/0152695, and U.S. Pat. No. 6,151,851.

SUMMARY OF THE INVENTION

An embodiment of the device disclosed herein is support form comprising, a first form member having an L-shaped cross section, a second form member having an L-shaped cross section, and a chamfer form.

The support form may further comprise a sealing member wherein the sealing member comprises a chamfer form.

Optionally, the support form may comprise a first portion formed to receive a curable material therein, and a second portion formed to receive a curable material therein, wherein the inner periphery of the second portion communicates with the inner periphery of the first portion and increases in size as it extends from the first portion. Here the first portion may comprise a first form member having an L-shaped cross section a second form member having an L-shaped cross section, and a chamfer form.

A method of forming a support column is included comprising creating a form by mating a first form member to a second form member, wherein each form member has a substantially L-shaped cross section, wherein the form has corner-like region on its inner periphery, and adding a chamfer form across the corner-like region.

DETAILED DISCLOSURE

Figure 1:
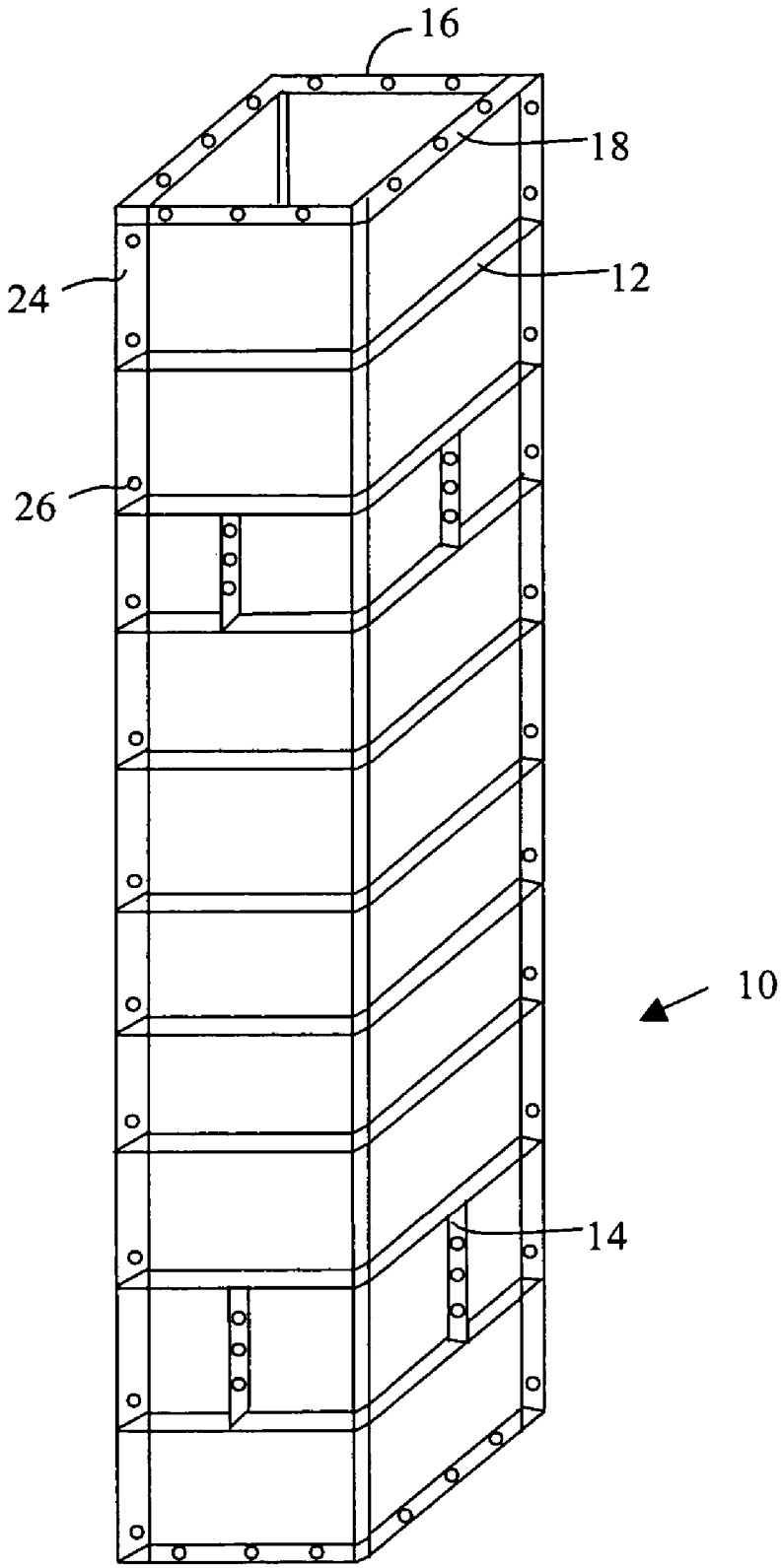
FIG. 1 is a perspective view of a form of one embodiment of the apparatus herein described.

With reference now to FIG. 1, an embodiment of a form for a support structure is shown in a perspective view. In this embodiment, the form 10 is shown fully assembled and wherein curable material may be included therein. The curable material for use with this form 10 includes cement, concrete, resins, polymeric material, and other substance that may harden over time into a shape consistent with the inner periphery of the form. Along the length of this embodiment, support ribs 12 are shown on the outer surface of the form 10 in generally horizontal configuration, supports ribs 12 are necessary especially when in light of the high density material used in conjunction with the form and the static pressures that may be present along the length of the form 10. Vertical support ribs 14 may also be included in this embodiment of the form for providing vertical support as well.

In the embodiment of FIG. 1, the form 10 is comprised of a pair of substantially L-shaped members joined together at their respective ends. The members are a first form member 16 and a second form member 18. These members both have an attachment means provided at their respective terminal ends. In this embodiment the attachment means is a flange 24 formed along each lengthwise edge of both the first and second form member (16, 18). Apertures 26 are provided within the flange 24 to receive fasteners therein for securing the first and second form members (16, 18) together. When secured, these members (16, 18) form a container capable of receiving therein a flowable material, i.e., cement or concrete, to be cured and formed into a solid member.

Figure 2A:
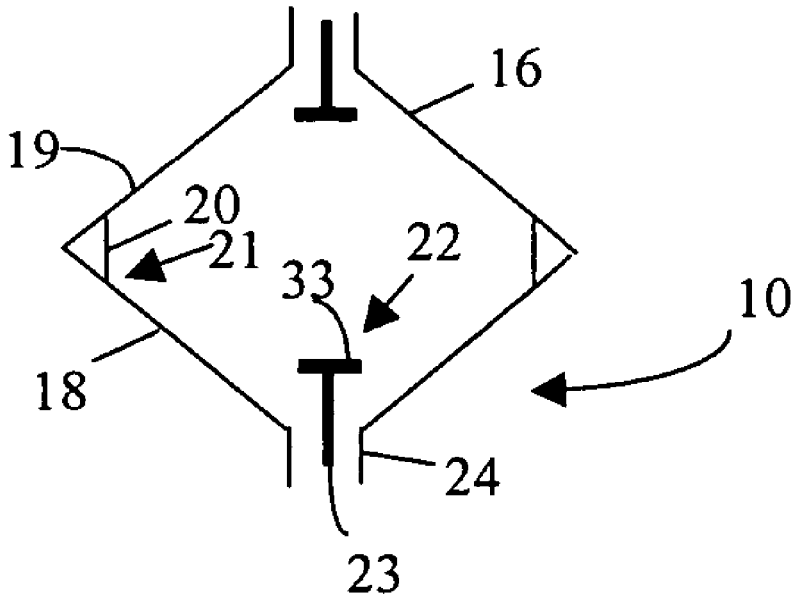
FIGS. 2*a* and 2*b* are overhead views of an embodiment of the device disclosed herein.
Figure 2B:
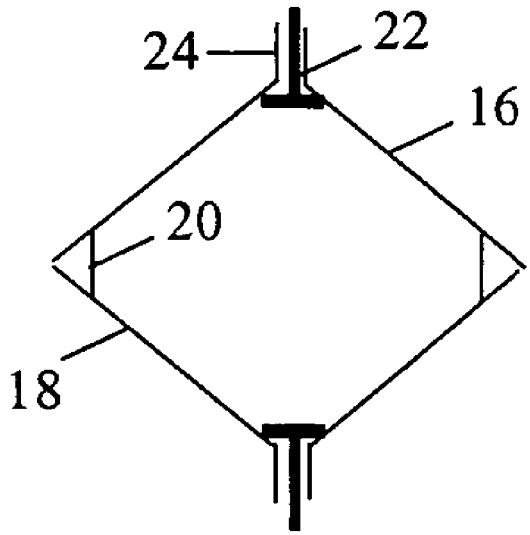

FIGS. 2*a* and 2*b* provide an overhead view of one embodiment of the form 10. With reference now to FIG. 2*a*, a semi-exploded view of form components is illustrated therein. In this embodiment, the first and second form members (16, 18) are shown apart and in a non-engaged configuration for illustrative purposes. As shown, the form members (16,18) have a substantially L-shaped cross section. The L-shaped form includes an angle 19 at roughly the mid-point of the cross section of each of these form members (16, 18). Due to the L-shape, the angle 19 is approximately 90° in magnitude.

Transversely disposed across the angle 19 is a chamfer form 20. The presence of the chamfer form 20 changes the inner periphery of the form 10 such that the roughly 90° angle 19 is replaced by a pair of angles (21, 23) where the magnitude of these angles is greater than 90°. It should be pointed out that the chamfer form 20 is not limited to the substantially straight shape as shown in FIG. 2*a*, but can include curved members as well.

Also shown in the embodiment of FIG. 2*a* is a cross sectional view of a sealing member 22. The sealing member 22 is comprised of an elongated tip 23 extending substantially perpendicularly away from a head 33. As shown, the tip 23 is formed to be disposed within the mating flanges (24, 25) of the respective form members (16, 18). This mating relationship of the sealing member 22 is provided in FIG. 2*b*, wherein the first and second form members (16,18) are shown in a mated configuration such that the opposing flanges (24, 25) are adjoined. With reference again now to FIG. 2*b*, when installed properly the sealing member 22, with its optional head 33 comprises a corresponding chamfer form that runs along the length of the form just inside of the mating flanges 24. Thus the embodiment of the form 10 of FIG. 2*b* includes a chamfered edge in each of the corners of the form 10.

Figure 3A:
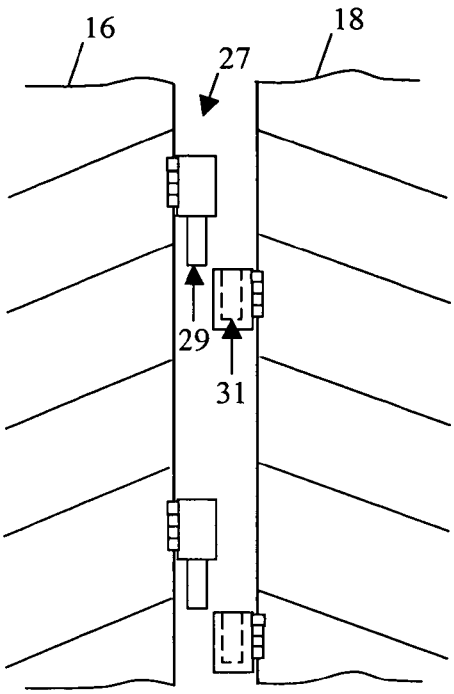
FIGS. 3*a* and 3*b* are side views of a form of an embodiment described herein.
Figure 3B:
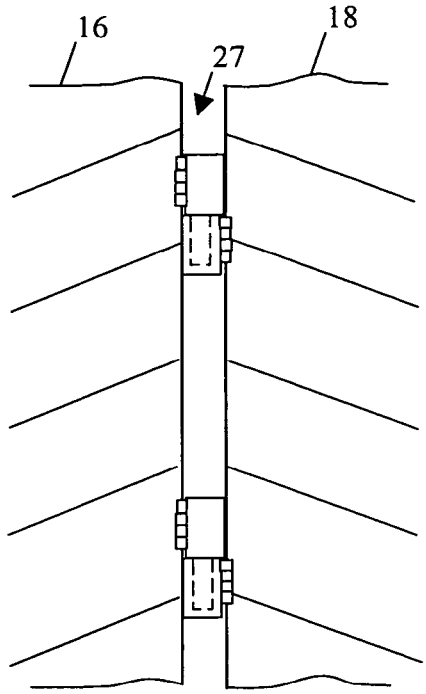

FIGS. 3*a* and 3*b* provide an alternative embodiment of connecting the first and second forming members. In this embodiment a series of hinges 27 are shown formed on the respective members. In the example shown hinge pins 29 are connected to one of the form members and corresponding receptacles 31 are provided on the other of the form members. A recess (shown in dashed outline) is formed within the receptacle 31. In the embodiment of FIG. 3*b* the hinge system is shown in connected form thereby hingedly mating the respective form members (16, 18).

Figure 4A:
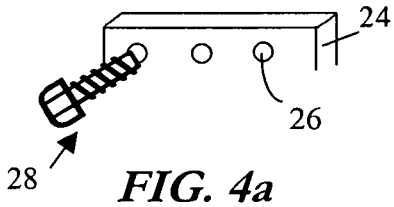
FIGS. 4*a*-4*c* portray embodiments of fasteners used in conjunction with the form herein described.
Figure 4B:
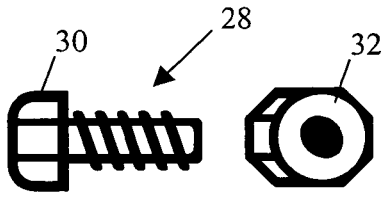
Figure 4C:
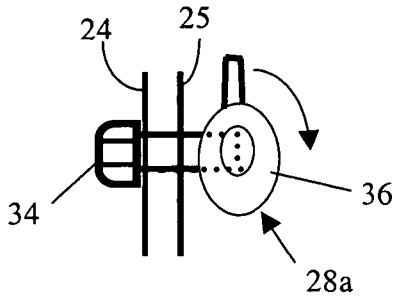

FIGS. 4*a*-4*c* provide some alternative embodiments of fasteners that can be used in connecting the respective form members (16, 18). In FIG. 4*a* a fastener 28 is shown in one embodiment for insertion into an aperture 26 formed on the flange 24 of one of the members. A corresponding nut 32 can be used to secure the free end of the bolt 28 for attachment means. Optionally, a fastener of FIG. 4*c* can be used to connect the opposing flanges (24, 25) of the respective form members (16,18). In this embodiment a stud 34 is shown protruding through corresponding apertures formed through the flanges (24 and 25). This embodiment of the fastener 28*a* is an elliptically shaped base member is pivotally attached to the far end of the stud 34. By rotating the elliptical member 36 the stud is pulled tighter in through the flanges thereby providing a connective force for fastening together the first form member 16 to the second form member 18.

Figure 5:
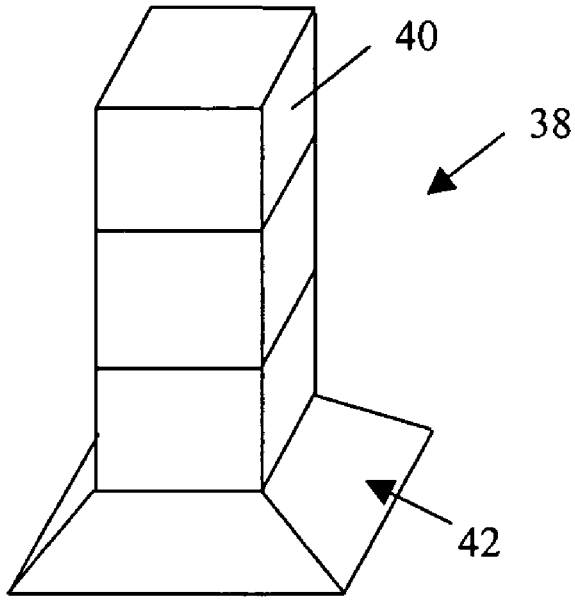
FIG. 5 is a perspective view of an embodiment of a form having a first section and a second section.

With reference to FIG. 5 an alternative embodiment of a form 38 is provided. In this embodiment the form 38 comprises an upper portion 40 and a lower portion 42. As shown the upper portion 40 has a substantially consistent dimensions along its length. However the lower portion 42 has an outer periphery that increases as the lower portion extends away from the upper portion 40. It should be pointed out that this embodiment may include the elements of the embodiment of FIG. 1 and FIG. 2*a*, 2*b*, i.e., the chamfer form 20 and the sealing member 22. Thus by using the form 38 of FIG. 5, a structural column may be produced having a lower portion 42 whose outer periphery extends outward past that of the periphery of the upper portion 40.

Figure 6:
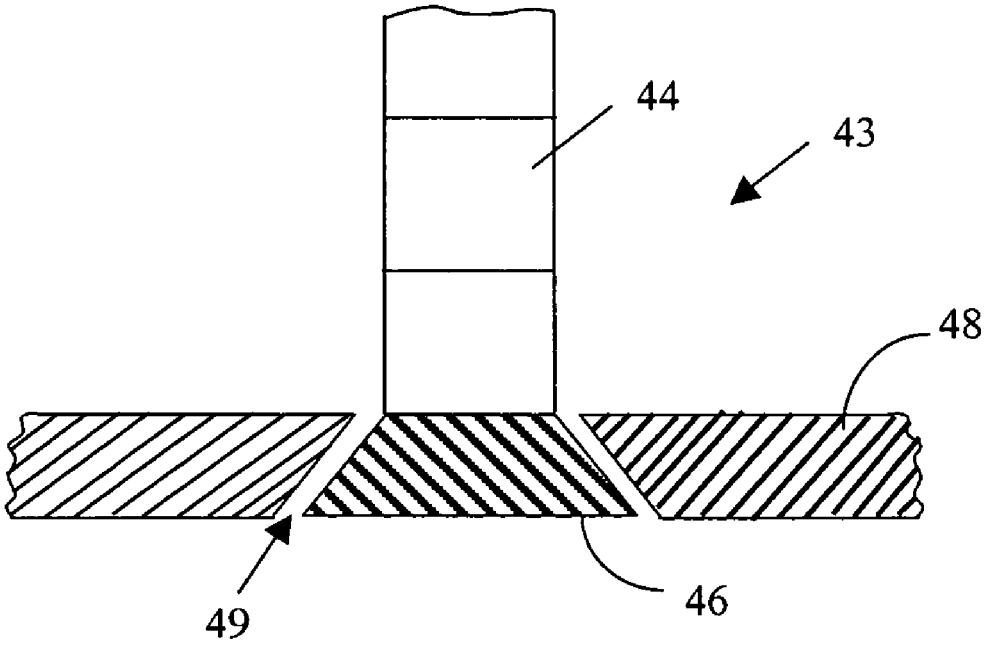
FIG. 6 is a partial cross-sectional view of a structural form in combination with the foundation.

FIG. 6 provides an example of a column 44 formed by the form 38 of FIG. 5. In this view, the support 43 comprises a support column 44 anchored by a base 46 on its lower portion. Also provided in this view of FIG. 6 is a foundation 48 that can be formed over the support 43 wherein the foundation 48 circumscribes and covers a substantial portion of the base 46. Although a gap 49 is shown between the outer periphery of the base 46 and the foundation 48 in FIG. 6, this gap 49 is provided for clarity and in use the gap may in fact not be present. One of the advantages of the support 43 of FIG. 6 is its coupling with the support provided by the foundation circumscribing the base, thereby substantially enhancing the structural capabilities of the support 43 both in lateral as well as in torsional loading conditions.

In operation, the first and second form members (16,18) may be transported to a site where a structural support is to be produced. One of the advantages of using these modular forms 10 herein described is that a single individual may transport the components necessary to assemble the form and install it as needed. Moreover, a single individual can transport components necessary for installing multiple forms. The installation procedure can include the fasteners provided in FIGS. 4*a*-4*c*, or any other currently known or later developed way or manner of fastening. Once assembled and properly leveled the form 10 can be put in place where the structure is to be set, and the curable material can be poured within the form 10 for creating the desired structural support. When it is determined that the material within the form 10 has properly set or cured, the fasteners can be removed and the members removed from the outer surface of the structure.

It should be pointed out that one of the many advantages of the chamfer form 20 is that the outer corners of the form will not be 90° but instead will have a flattened portion along their length. This flattened portion not only provides a more aesthetically appealing final product, is less prone to chipping, but also aides in the removal of the form members 16, 18 after the structural material has cured.

Embodiments of the methods and devices described herein, therefore, are well adapted to carry out the objects and attain the ends and advantages mentioned, as well as others inherent therein. While a presently preferred embodiment has been given for purposes of disclosure, numerous changes exist in the details of procedures for accomplishing the desired results. For example, the members making up the form can be comprised of various types of metal, including carbon steel, aluminum, and other similarly durable materials. Optionally, the members can be comprised of polymeric or other synthetic compositions. Additionally, the device and method can be used in conjunction with downhole drilling or other boring operations. These and other similar modifications will readily suggest themselves to those skilled in the art, and are intended to be encompassed within the spirit of the present invention disclosed herein and the scope of the appended claims.

What is claimed is:

1. A method of forming a structural support system comprising:

positioning a hollow, base form at a first elevation, said base form having an upper surface and a lower surface, said lower surface having a greater periphery than said upper surface;

positioning a hollow column form having an upper open end on the upper surface of said base, said hollows in said base form and said column form being in open communication;

said column form comprising:

first and second L-shaped sections, said first L-shaped section comprising a first leg and a second leg adjoined to form a first corner, a first chamfer forming member disposed adjacent said first corner, said first leg having a first flange extending laterally outwardly from the end of said first leg distal said first corner, said second leg having a second flange extending laterally outwardly from the edge of said second leg distal said first corner;

said second L-shaped member comprising a third leg and a fourth leg adjoined to form a second corner, a second chamfer forming member disposed adjacent said second corner, said third leg having a third flange extending laterally outwardly from the end of said third leg distal said second corner, said fourth leg having a fourth flange extending laterally outwardly from the end of said fourth leg distal said second corner, said first and second flanges being generally coplanar, said third and fourth flanges being generally coplanar;

disposing a first T-shaped seal having a first T-leg between said first and third flanges, said first T-seal having a second T-leg transverse to said first T-leg, and forming a third chamfer forming member;

disposing a second T-shaped seal having a third T-leg between said second and fourth flanges, said second T-seal having a fourth T-leg transverse to said third T-leg and forming a fourth chamfer forming member;

forcing said first and third flanges into engagement with said first T-leg of said first T-seal;

forcing said second and fourth flanges into engagement with said fourth T-leg of said second T-seal; and introducing a curable material into the upper open end of said second form whereby said curable material fills said hollows in said column form and said base form.

2. A support form comprising:

a first form member having an L-shaped cross section, said first form member comprising first and second legs adjoined to form a first corner, a first chamfer forming member secured to said first and second legs adjacent said first corner;

first and second flanges extending laterally outwardly from the ends of said first and second legs, respectively;

a second form member having an L-shaped cross section, said second form member comprising third and fourth legs adjoined to form a second corner, a second chamfer forming member secured to said third and fourth legs adjacent said second corner;

third and fourth flanges extending laterally outwardly from the ends of said third and fourth legs, respectively;

a first T-shaped insert having a first T-leg positioned between said first and third flanges and a second T-leg transverse to said first T-leg, said second T-leg forming a third chamfer forming member, when said first T-leg is compressed between said first and third flanges;

a second T-shaped insert having a third T-leg positioned between said second and fourth flanges and a fourth T-leg transverse to said third T-leg, said fourth T-leg forming a fourth chamfer member when said fourth T-leg is compressed between said second and fourth flanges;

a first fastener for compressing said first T-leg between said first and third flanges; and a second fastener for compressing said third T-leg between said second and fourth flanges.

* * * * *